United States Patent [19]

Ochs

[11] Patent Number: 4,530,193

[45] Date of Patent: Jul. 23, 1985

[54] BUILT-UP ROOF STRUCTURE AND METHOD OF PREPARING ROOF STRUCTURE

[75] Inventor: Gregory J. Ochs, Forest Lake, Minn.

[73] Assignee: Minnesota Diversified Products, Inc., New Brighton, Minn.

[21] Appl. No.: 631,082

[22] Filed: Jul. 16, 1984

[51] Int. Cl.[3] ..... E04B 5/00; E04D 3/35

[52] U.S. Cl. ..... 52/408; 52/747; 52/309.8; 52/309.12

[58] Field of Search ..... 52/408, 309.8, 309.12, 52/747, 409, 410

[56] References Cited

U.S. PATENT DOCUMENTS

| | | | |
|---|---|---|---|
| Re. 31,007 | 8/1982 | Best | 52/408 |
| 2,019,647 | 11/1935 | Basten et al. | 108/10 |
| 2,191,522 | 2/1940 | Eckert | 168/6 |
| 2,861,525 | 11/1958 | Curtis et al. | 108/65 |
| 3,103,042 | 9/1963 | Martin | 52/409 |
| 3,266,206 | 8/1966 | Cosby et al. | 52/309 |
| 3,282,008 | 11/1966 | Sheahan | 52/516 |
| 3,411,256 | 11/1968 | Best | 52/408 |
| 3,466,222 | 9/1969 | Curtis | 161/160 |
| 3,616,173 | 10/1971 | Green | 161/162 |
| 3,763,614 | 10/1973 | Hyde et al. | 52/309 |
| 3,965,633 | 6/1976 | Carroll | 52/410 |
| 4,272,936 | 6/1981 | Bonaguidi | 52/309.12 |
| 4,351,138 | 9/1982 | McMillan et al. | 52/747 |
| 4,492,064 | 1/1985 | Bynoe | 52/408 |

FOREIGN PATENT DOCUMENTS

| | | | |
|---|---|---|---|
| 1816577 | 6/1970 | Fed. Rep. of Germany | 52/199 |
| 2742444 | 3/1979 | Fed. Rep. of Germany | 52/408 |

*Primary Examiner*—Henry E. Raduazo
*Assistant Examiner*—Caroline Dennison
*Attorney, Agent, or Firm*—Kinney & Lange

[57] ABSTRACT

A built-up roof structure includes an insulating layer of expanded, foamed, closed cell, polystyrene insulation panels covering an entire roof. A water impermeable membrane is laid loosely over all of the insulation panels, and a protective layer of extruded, foamed, closed cell, polystyrene protection panels is installed over the membrane to have fissures between each protection panel to allow rain water to run down to the upper face of the membrane. Downwardly open channels are provided in the bottom of each of the protection panels to facilitate runoff. The method of installing such a built-up roof structure includes first laying down the insulating layer made up of all of the insulation panels fit closely together over the entire roof, second loosely laying a water impermeable membrane over the top of the insulation layer, and third, laying down the protective layer made up of the protection panels spaced adjacent each other but far enough apart to allow water to run down between the edges of the protection panels to facilitate drainage.

19 Claims, 6 Drawing Figures

BUILT-UP ROOF STRUCTURE AND METHOD OF PREPARING ROOF STRUCTURE

BACKGROUND OF THE INVENTION

1. Field of the Invention

This invention has relation to built-up roof structures useful to insulate and protect relatively flat roofs.

2. Description of the Prior Art

It is known to prepare a built-up roof structure by supporting a waterproof membrane comprising a plurality of alternating layers of felt and layers of bituminuous material directly on the upper surface of a roof deck, with a thermal insulating layer of closed cell, foamed insulating members defining fissures between adjacent members to allow water to run down between these members to the membrane. A water permeable layer of loose gravel is spread over the surface of the insulating layer to complete the structure. See U.S. Pat. No. 3,411,256 granted Nov. 19, 1968, now U.S. Pat. No. Re. 31,007, reissued Aug. 10, 1982.

It is known to place a non-combustible fire resistant layer of gypsum board directly on a roof deck and then to adhere the aforementioned water impermeable membrane of alternating layers of felt and hot bituminous material or asphalt directly to the board. A layer of thermal insulation comprising closed cell, water impervious cellular insulating material is then affixed to the membrane. See U.S. Pat. No. 3,763,614, granted in October of 1973.

The prior art in relation to the present invention includes the art cited against these above-mentioned patents and as set out and discussed in the protest filed by The Celletex Corporation on Dec. 14, 1978 and in the Petition for Institution of Public Use Proceedings filed by The Celletex Corporation on Aug. 16, 1979, this art appearing in the file wrapper record of the Best reissue patent, U.S. Pat. No. Re. 31,007.

The file of now closed litigation pending in the United States District Court for the Middle District of Florida, Tampa Division, identified as The Dow Chemical Company v. The Celletex Corporation, Civil Action 77-0052, filed Jan. 24, 1977 is known to contain material pertinent to the prior art as set out in U.S. Pat. No. 3,411,256. The record of this litigation has not been examined, however, by applicant or those in privity with him.

Applicant and those in privity with him are aware of no closer prior art than that set out above; and they are aware of no prior art which anticipates the claims herein.

SUMMARY OF THE INVENTION

A built-up roof structure for installation on the roof of a building having a generally flat roof includes laying down an insulating layer of relatively soft surfaced, foamed, closed cell insulation panels supported by the upper surface of the roof deck, laying a water impermeable membrane over this insulating layer, and laying a protective layer of relatively strong, foamed, relatively dense, closed cell protection panels over the membrane. In the form of the invention shown, these protection panels are spaced sufficiently from each other so that water can penetrate down the sides of the panels to reach the waterproof membrane, and the protection panels are provided with downwardly open channels, also to facilitate runoff. A number of the advantages of the present invention would be obtained, however, if the protection panels were sealed so that no water passed through them and reached the top of the membrane. One of the primary advantages of this structure would be the protection of the membrane by having the relatively strong and hard protection layer on top of it and the relatively soft surfaced insulation layer below it so that any deformation caused from above would be reflected by a deformation in the surface of the insulation panels below.

DETAILED DESCRIPTION OF THE PREFERRED EMBODIMENTS

Figure 1:
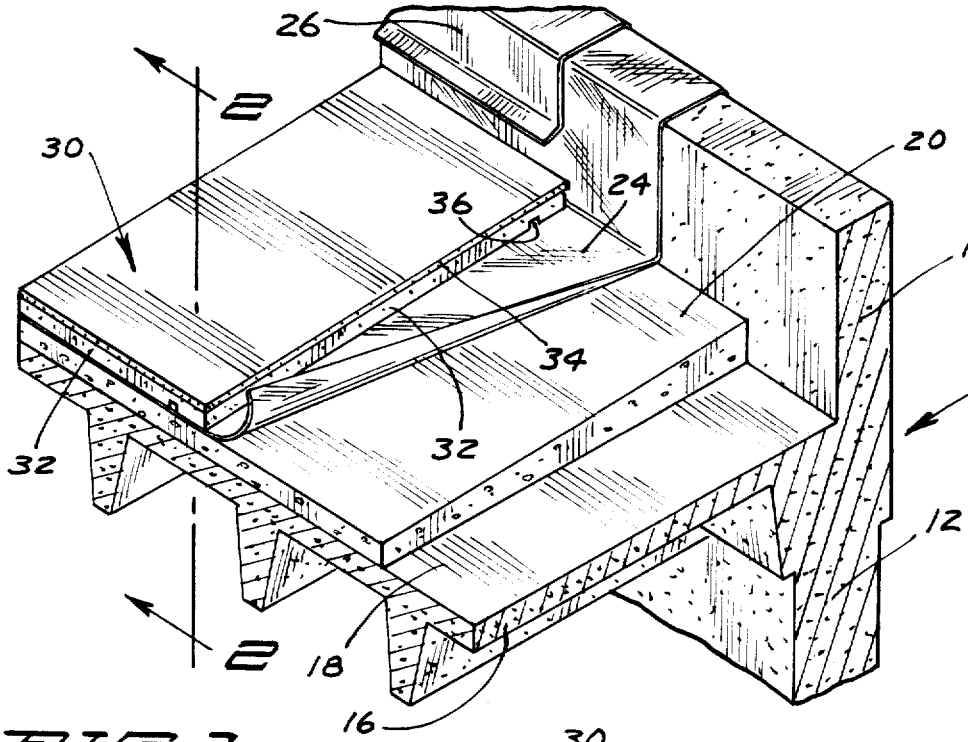
FIG. 1 is a fragmentary view of a portion of a flat concrete roof deck with elements of the built-up roof structure of a first form of the present invention shown thereon.

A fragment of a building construction 10, as seen in FIGS. 1, 2, 3, 4 and 6 includes outer building walls 12 topped by a parapet 14, and a roof deck 16. The roof deck is provided with a flat, horizontal upper surface 18. This is a typical roof deck. The built-up roof structure and method of the invention can also be utilized in connection with roof decks made of other materials such as wood or steel, for example. The roof deck can also lie at angles other than horizontal.

Figure 2:
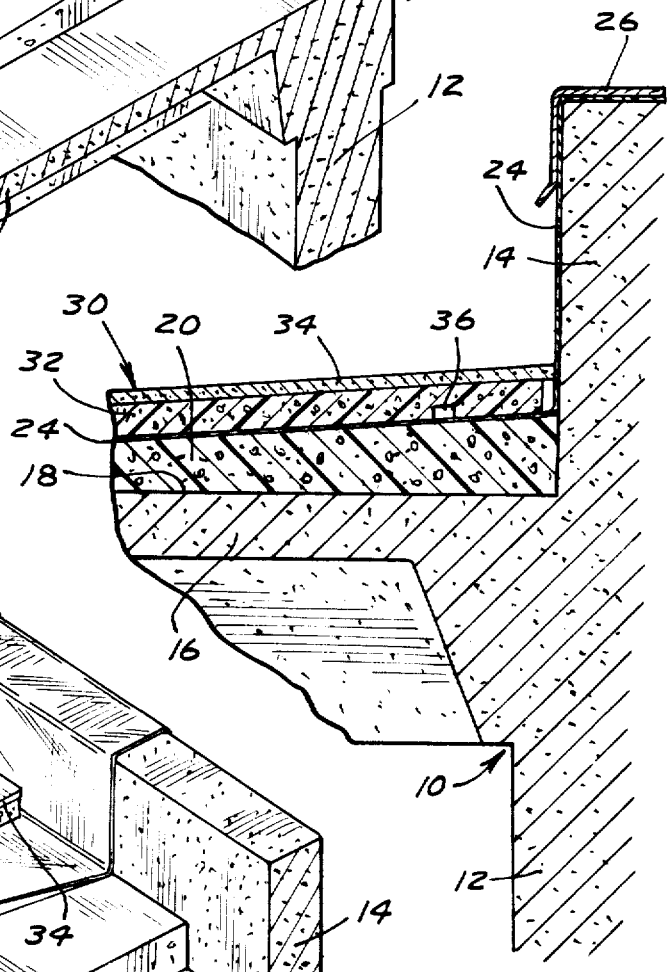
FIG. 2 is an enlarged fragmentary vertical sectional view taken as on the line 2—2 in FIG. 1.
Figure 3:
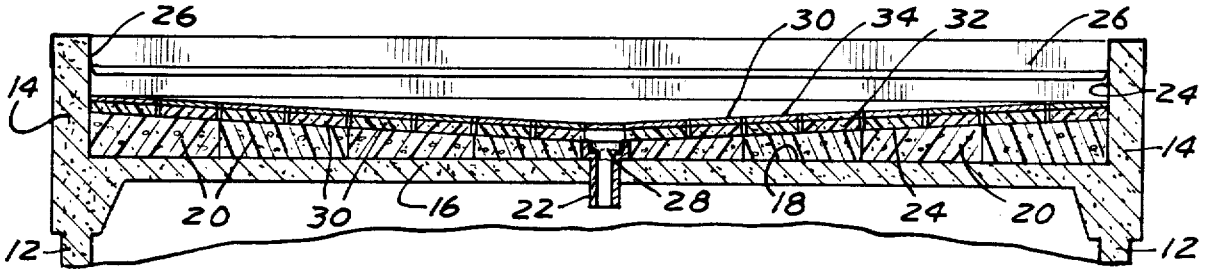
FIG. 3 is a fragmentary, vertical, cross sectional view at a reduced scale also taken as on the line 2—2 in FIG. 1 of an entire span of roof deck and the roof structure across a complete building construction from outer wall to outer wall.

A first embodiment of the invention is disclosed in FIGS. 1, 2 and 3. A plurality of tapered, closed cell insulation panels 20 made, for example, of expanded, foamed, polystyrene are laid side by side in such a manner as to form an insulating layer covering the entire upper surface 18 of the roof deck 16. As seen in FIGS. 1, 2 and 3, panels 20 are tapered from the parapet downwardly toward the center of the roof deck, and, as seen in FIG. 3, toward a precipitation water drain conduit 22 extending upwardly from, and open through, the roof deck 16.

A water impermeable membrane 24, for example, a single ply membrane exhibiting the properties of a modified rubber sheet, has an upper face and a lower face and is loosely laid over the entire composite upper face of the insulating layer. Outer peripheral edges of the membrane 24 will extend up over the top edge of parapet 14 and will be sealed against the passage of moisture between it and the top of the parapet by means of a metal coping 26, for example, in any usual or preferred manner, forming no part of the present invention per se. Similarly, an opening 28 will be provided in the membrane in alignment with the drain conduit 22, and the edges of the membrane will be sealed to the inner surfaces of the drain conduit 22 in any usual or preferred manner to insure that moisture in fluid form arriving at the upper face of membrane 24 will all flow into and through drain conduit 22. The seal of the membrane to the conduit forms no part of the invention per se.

On the upper face of water impermeable membrane 24 is laid a plurality of protection panels 30 to form a composite protective layer extending over the membrane 24 to cover the entire composite upper face of the insulating layer made up of insulation panels 20. In accordance with this first form of the invention, these protection panels include a lower layer of extruded, foamed, closed cell, polystyrene protection panel base members 32 of relatively high density and strength; and an upper layer of cementatious coating forming protection panel cap members 34 bonded to the upper surface of the base members 32.

The protection panel base members 32 of the protection panels 30 are each provided with downwardly open channels 36. These channels provide a passageway for precipitation water, or any other liquid for that matter, to drain along the upper face of the membrane 24 from high points to a low points thereof.

When the protection panels 30 are first laid side by side in coplanar relationship to each other, they will not be jammed together tightly, but will be spaced to have fissures therebetween. Thus, any precipitation which lands on the built-up roof structure, when in liquid form, will run down the fissures between the protection panels 30, and through the channels 36 therein to the low point of the roof where the precipitation will be drained away, through precipitation water drain conduit 22, for example.

Figure 5:
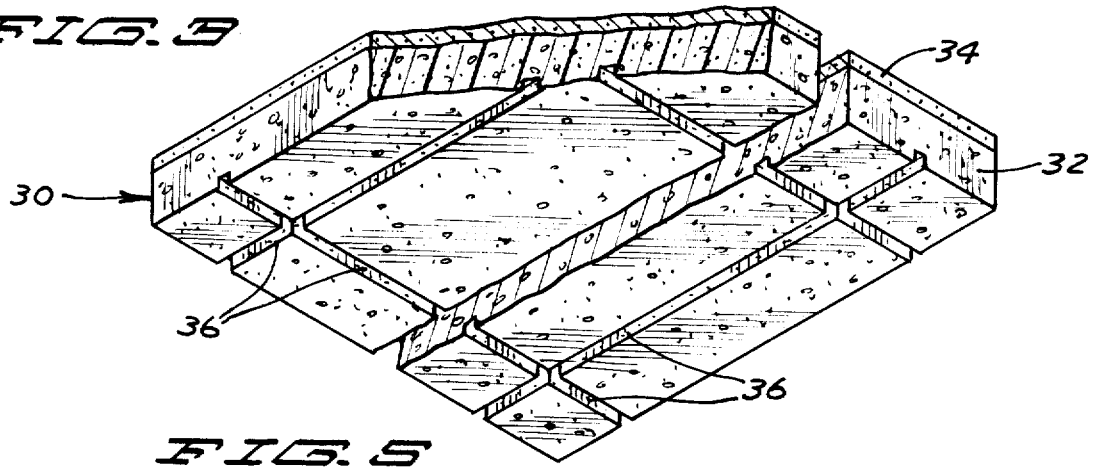
FIG. 5 is a fragmentary perspective view of a typical protection panel useful in the present invention as seen, for example, from below the closest corner of the protection panel illustrated in FIG. 4.

As will be explained in connection with the second form of the invention and particularly as seen in FIG. 5, the channels 36 run longitudinally and transversely of the protection panels. It has been found that the channels are most effective when they are spaced not more than 12 inches (30 centimeters) from each other. Channels can also be provided along the edges of the protection panels.

Figure 4:
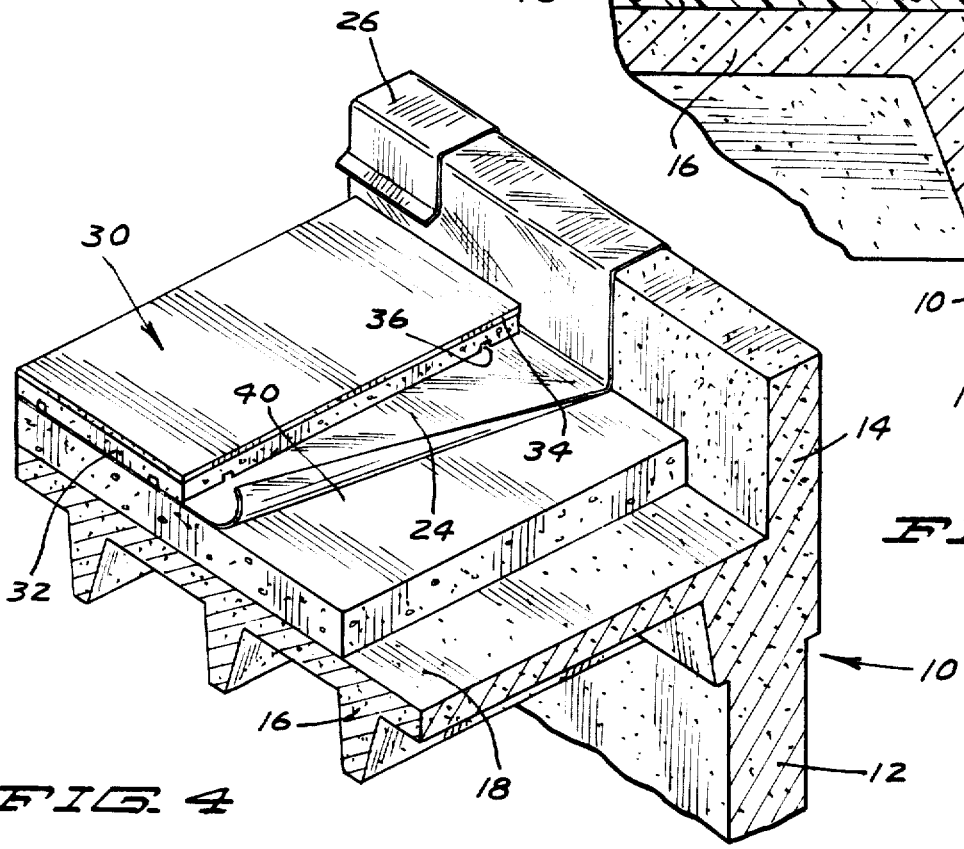
FIG. 4 is a fragmentary perspective view of a flat concrete roof deck with elements of a built-up roof of a second form of the invention positioned thereon.

The second form of the invention is shown in FIGS. 4 and 5. This second form of the invention differs from the first form only in that closed cell insulation panels 40 of uniform thickness have replaced the tapered insulation panels 20 as seen in the first form of the invention. This form of the invention will be particularly useful where the upper surface of the roof such as the roof 16 is not entirely flat, but is sloped toward a drain opening. Protection panels of uniform thickness are also useful where it is necessary or desirable that the entire roof have the same, completely uniform, R value. The other elements of the built-up roof structure, being identical with the same elements of the first form of the invention, are numbered identically.

In connection with the second form of the invention where the insulation panels form a uniform thickness are laid on a flat roof, the precipitation water will eventually seek its lowest level, and will eventually drain off at whatever spot on the level roof is provided with a drain passageway. However, before the water can drain off, in heavy downpours, for example, it is expected that the individual protection panels 30 will float on the precipitation water. Since each protection panel has a uniform thickness of cementatious coating tending to weigh it down, adjacent edges of adjacent protection panels will tend to float at about the same height, so that, even as they float, none will be moved in any substantial manner relative to the others. As the water drains off of the roof, in either the first or second form of the invention, the protection panels will, of course, sink to their place on the upper face of the membrane, and any residual water still present will travel through channels 36 to find its lowest possible level.

Figure 6:
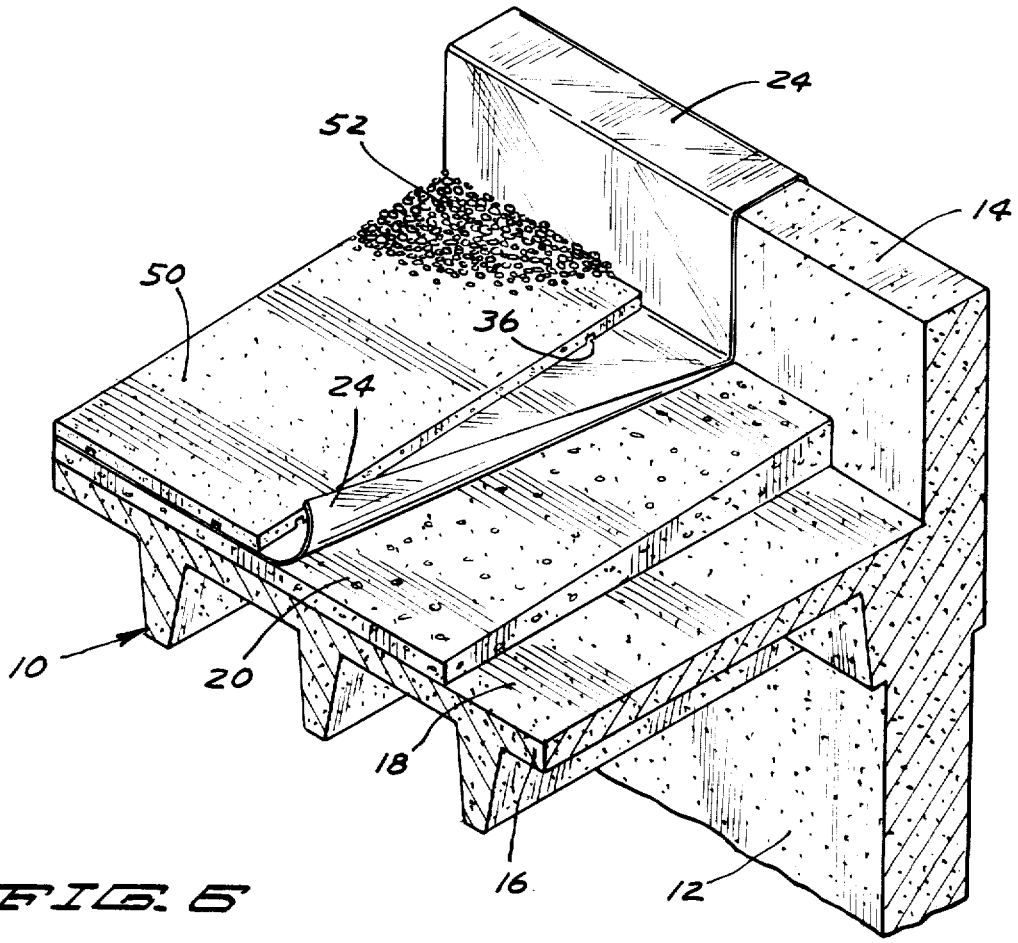
FIG. 6 is a fragmentary perspective view of a flat concrete roof deck with fragments of the elements of a third form of the invention disclosed thereon.

A third form of the invention as seen in FIG. 6 is identical with the first form of the invention with the exception of the fact that protection panels 50 replace protection panels 30, are of uniform thickness throughout and are made up entirely of extruded, foamed, closed cell polystyrene of relatively high density and strength, and do not have any upper layer thereon. In order to hold these protection panels 50 in place with respect to each other, a loading layer of loose gravel ballast 52 is positioned over the entire composite upper face of the protective layer formed by all of the protection panels. By using gravel having a diameter of approximately three-quarters of an inch (2 centimeters), spread to a depth of approximately two inches (5 centimeters), an adequate loading effect can be obtained without having the gravel work down through the fissures between the individual protection panels. Where cuts are made through or into the edges of individual panels to clear stacks and other upward projections through the roof, gravel of one inch to one and one-half inch in diameter (2.5 to 4 centimeters) can be used above any spaces between the protection panels and the upward projections.

In this third form of the invention, the parts which are identical with the parts in the first form of the invention are identically numbered.

The method of preparing the built-up roof of the first form of the invention as seen in FIGS. 1, 2 and 3 includes covering the roof deck with an insulating layer of tapered, closed cell insulation panels 20. The panels will be chosen so that the tapers will be from the outside edges of the roof deck 16 downwardly toward a common low point where precipitation in liquid form can run to be drained off of the roof. Panels of foamed polystyrene are useful for this purpose because they are relatively soft on the outside, but have good compressive strength. This is important in the protection of the impermeability of the water impermeable membrane 24 to be loosely laid on top of it. For example, should someone walk on the membrane 24 in the act of installing it, or should a hard object dropped by a person using the built-up roof or a pebble or a hail stone get between the protective layer and the membrane 24, and should a protection panel of that layer be forced down against the hard object and against the membrane, it is important that the insulation layer have the ability to deform evenly and smoothly as the hard object and the membrane are pushed down into it. Also, insulation panels exhibiting those properties of expanded polystyrene are useful because the individual insulation panels can easily be cut to fit at corners of the roof, or around vertical projections up from the roof, or at intersections of portions of the insulating layer having different slopes.

After the insulating layer is installed over the entire surface of the roof 16, the water impermeable membrane is laid loosely over the entire composite upper surface of the insulating layer and of the insulation panels 20 which make up that layer. Edges of the membrane will be sealed to the top edge of the parapet 14 using the metal coping 26 or any other usual or preferred sealing means. A membrane opening 28 will be provided in the membrane in line with the precipitation water drain 22, and the edges of the opening will be sealed so that water running off of the top surface of the membrane will all pass into the drain conduit 22. In order to accommodate vertical upward projections from the roof (not shown), further openings in the membrane will have to be provided; and the edges of the membrane will be sealed to prevent the passage of precipitation water or other liquid through those openings.

Next, the protection panels 30 will be installed on top of the membrane in edge to edge relationship, but the spacing of these protection panels will be such that there will be fissures between adjacent panels, between the parapet wall and the panels adjacent to it, and between any vertical upward projections and the panels adjacent those projections. The panels, as shown herein, are constituted as being relatively stronger than the insulation panels and being relatively more dense than the insulation panels. Extruded polystyrene is the main ingredient in such panels; but any panels exhibiting those properties or some of those properties of extruded polystyrene will be suitable for the purpose. The reason for the high strength, high density protection panels is so that, when the roof is finally built up according to the first form of the invention, as seen in FIGS. 1, 2 and 3, persons using the roof or inspecting it can walk freely on any part of it without damaging the roof in any way. With the relatively hard bottom face of the protection panels resting against the membrane which rests on the relatively softer upper face of the insulation panels, even if hard objects should get between the protection panels and the membrane, the combination will be such that the chance of puncturing through the membrane and destroying the validity of the roof are very substantially minimized. The relatively higher density of the protection panel base layer and the presence of a cementatious cap layer makes the protection panels heavier and much less buoyant than would be the expanded foamed panels used as the insulation panels. This tends to minimize the lift of each of these panels when the precipitation water flowing on the membrane cannot be carried off fast enough to prevent floating; and protects the protection panels from being dislayed by violent winds.

Materials other than expanded, foamed, closed cell polystyrene, but exhibiting at least some of the properties thereof, can be used to form the insulation panels; while materials other than extruded, closed cell polystyrene, but exhibiting at least some of the properties thereof, can be used to form the protection panels.

The method of preparing the built-up structure of the second form of the invention as seen in FIGS. 4 and 5 is identical with the method of the first form of the invention with the exception of the fact that the insulation panels 40 are of uniform thickness so that, when the built-up roof structure of the second form of the invention is laid on a roof having a flat, horizontal surface 18, the precipitation liquid will run off at whatever drain is provided, if any, at a somewhat slower rate as the water passes over the top of the protection panels and as it passes through the fissures between panels and along the downwardly open channels 36 in the protection panel base members 32 of the protection panels 30. Of course where these insulation panels 40 are part of a built-up roof structure on a slightly slanting roof surface, the runoff to drain will be more rapid.

The method of preparing a built-up roof according to the third form of the invention as seen in FIG. 6 will be identical with the method of claim 1 with the exception of the fact that protection panels 50, being composed entirely of extruded, foamed, closed cell polystyrene will be used without any built-in or built-on high density, high weight upper cap layers. These protection panels 50 will, of course, be provided with the downwardly open channels 36.

In the three forms of the invention illustrated herein, the protection panels are permanently positioned with respect to each other (whether they float temporarily up away from the water impermeable membrane 24 or not) by loading them from the top either with a cementatious coating or with loose gravel. Thus, when the water on the roof, or any part of the roof, becomes deep enough to float the protection panels on the roof or on that part of the roof, all of the panels will float up at substantially the same time and to the same distance, so that the relative positioning of each with respect to the others will not be changed. Other methods of permanently positioning the panels of the protective layer with respect to each other can be used without departing from the spirit of the invention and the scope of the claims which follow. For example, each panel can be loosely tied to all of its adjacent panels, leaving room for the fissures between the panels. Also, a water permeable netting could be placed over all of the protection panels. Other methods of anchoring will suggest themselves to fit particular situations.

Although the present invention has been described with reference to preferred embodiments, workers skilled in the art will recognize that changes may be made in form and detail without departing from the spirit and scope of the invention.

What is claimed is:

1. A roof structure for installation on a roof deck having an upper surface, said roof structure including:

A. an insulating layer of relatively soft surfaced, foamed, closed cell insulation panels supported by the upper surface of the deck;

B. a water impermeable membrane laid over the insulating layer, said membrane having an upper face and a lower face; and C. a protective layer of relatively strong, foamed, closed cell protection panels positioned over the membrane and having fissures therebetween.

2. A roof structure for installation on a roof deck having an upper surface, said roof structure including:

A. an insulating layer of relatively soft surfaced, foamed, closed cell insulation panels supported by the upper surface of the deck;

B. a water impermeable membrane laid loosely over the insulating layer, said membrane having an upper face and a lower face;

C. a protective layer of relatively strong, foamed, closed cell protection panels positioned over the membrane and having fissures therebetween, each of said protection panels having an upper and a lower face; and D. means for fixedly positioning the panels of the protective layer against displacement with respect to each other by wind or water.

3. The roof structure of claim 2 wherein:

E. the means for fixedly positioning the panels of the protective layer includes a permanent cementatious coating bonded to the upper face of each of said protective panels.

4. The roof structure of claim 2 wherein:

E. the means for fixedly positioning the panels of the protective layer includes a loading layer of loose gravel ballast positioned over the upper face of each of the panels of the protective layer.

5. The roof structure of claim 2 wherein:

E. the lower faces of the protection panels are provided with downwardly open channels positioned to allow precipitation water reaching the upper face of the membrane to flow to a low point on the membrane.

6. The roof structure of claim 5 wherein:

F. first channels provided in the lower faces of the protection panels are situated in spaced, parallel relation to each other;

G. second channels so provided intersect the first channels and extend at right angles to them; and H. all such first and second channels extend from edge to edge of their protection panels.

7. The roof structure of claim 6 wherein:

I. the channels in a particular protection panel which are parallel with each other are spaced no farther apart than 12 inches (30 centimeters).

8. The roof structure of claim 2 for use on a roof deck having a precipitation water drain conduit open to carry water away from the deck, wherein:

E. at least some of the insulation panels of said insulating layer are tapered to have varying thicknesses and are positioned on the deck so that the composite upper surface of the insulating layer and the upper surface of the membrane loosely laid thereon each slope generally in direction toward the drain conduit; and F. a water passageway is provided from the upper surface of the membrane into the drain conduit.

9. The roof structure of claim 8 wherein:

G. the lower faces of the protection panels are provided with downwardly open channels positioned to allow precipitation water reaching the upper face of the membrane to flow to a low point on the membrane.

10. The roof structure of claim 9 wherein:

H. first channels provided in the lower faces of the protection panels are situated in spaced, parallel relation to each other;

I. second channels so provided intersect the first channels and extend at right angles to them; and J. all such first and second channels extend from edge to edge of their protection panels.

11. The roof structure of claim 10 wherein:

K. the channels in a particular protection panel which are parallel with each other are spaced no farther apart than 12 inches (30 centimeters).

12. The method of preparing a built-up roof on a roof deck, said method including the steps of:

A. covering the roof deck with an insulating layer of relatively soft, foamed, closed cell insulation panels;

B. laying a water impermeable membrane over the insulating layer; and

C. supporting on top of the membrane a protective layer of relatively high density and high strength, foamed, closed cell protection panels in coplanar disposition and having fissures therebetween.

13. The method of preparing a built-up roof on a roof deck, said method including the steps of:

A. covering the roof deck with an insulating layer of relatively soft, foamed, closed cell insulation panels;

B. loosely laying a water impermeable membrane over the insulating layer;

C. supporting on top of the membrane a protective layer of relatively high density and high strength, foamed, closed cell protection panels in coplanar disposition and having fissures therebetween; and D. permanently positioning the panels of the protective layer with respect to each other to guard against water or wind displacement.

14. The method of preparing a built-up roof on a roof deck, said method including the steps of:

A. covering the roof deck with an insulating layer of relatively soft, foamed, closed cell insulation panels;

B. loosely laying a water impermeable membrane over the insulating layer;

C. supporting on top of the membrane a protective layer of relatively high density, high strength, closed cell protection panels in coplanar disposition and having fissures therebetween; and D. loading the panels of the protective layer from above to guard against water or wind displacement of the protection panels with respect to each other.

15. The method of claim 14 wherein:

E. the step of loading the panels of the protective layer includes first bonding to the upper surfaces of each of the protection panels a permanent cementatious coating.

16. The method of claim 14 wherein:

E. the step of loading the panels of the protective layer includes finally applying a ballast of loose gravel over the protective layer.

17. The method of claim 14 for use on a roof deck having a precipitation water drain conduit open to carry water away from the deck, wherein:

E. the step of first covering the roof deck with an insulating layer of insulation panels includes using tapered insulation panels of varying thickness and assembling the panels on the roof deck in such a manner that the composite upper face of the insulating layer and the upper face of the membrane laid loosely over the insulating layer each slope generally in direction toward the drain conduit; and F. including the additional step of providing a precipitation water drain passageway from the upper face of the membrane into the drain conduit.

18. The method of claim 17 wherein:

G. the step of loading the panels of the protective layer includes first bonding to the upper faces of each of the protection panels a permanent cementatious coating.

19. The method of claim 17 wherein:

G. the step of loading the panels of the protective layer includes finally applying a ballast of loose gravel over the protective layer.

* * * * *